US007448913B2

(12) United States Patent
Yahiro et al.

(10) Patent No.: US 7,448,913 B2
(45) Date of Patent: Nov. 11, 2008

(54) CONNECTOR

(75) Inventors: Yasufumi Yahiro, Tokyo (JP); Nobukazu Kato, Tokyo (JP); Tomohiko Tamada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/796,019

(22) Filed: Apr. 26, 2007

(65) Prior Publication Data

US 2007/0264875 A1 Nov. 15, 2007

(30) Foreign Application Priority Data

May 10, 2006 (JP) ..... 2006-131113
Jan. 17, 2007 (JP) ..... 2007-007681

(51) Int. Cl.
*H01R 24/00* (2006.01)

(52) U.S. Cl. ..... 439/637

(58) Field of Classification Search ..... 439/637, 439/631, 541.5, 326; 235/441, 444; 361/737
See application file for complete search history.

(56) References Cited

U.S. PATENT DOCUMENTS 6,607,395 B2 * 8/2003 Hashimoto ..... 439/326
6,776,653 B1 * 8/2004 Hsiao ..... 439/541.5
6,896,548 B2 * 5/2005 Scuteri et al. ..... 439/541.5
7,029,306 B2 * 4/2006 Bilcauu et al. ..... 439/326

FOREIGN PATENT DOCUMENTS

JP 3027049 U 5/1996

* cited by examiner

*Primary Examiner*—Alexander Gilman
(74) *Attorney, Agent, or Firm*—Frishauf, Holtz, Goodman & Chick, P.C.

(57) ABSTRACT

A connector which enables effective use of the space on a circuit board effectively, and facilitates impedance matching between contacts. The connector is comprised of a first connector section (1) and a second connector section (2). A receiving hole (11*d*) is formed in a first housing (11) of the first connector section (1), for receiving and holding a terminal section (71) of a first function expansion card (7). A plurality of contacts (12, 13) are arranged in the first housing (11), for electrically connecting the first function expansion card (7) to a printed wiring board (9). A first locking device (14) is disposed in the first housing (11), for locking a rear end of a second function expansion card (8). A receiving hole (21*d*) is formed in a second housing (21) of the second connector section (2), for receiving and holding a terminal section (81) of the second function expansion card (8). A plurality of contacts (22, 23) are arranged in the second housing (21), for electrically connecting the second function expansion card (8) to the printed wiring board (9). A second locking device (24) is disposed in the second housing (21), for locking a rear end of the first function expansion card (7).

19 Claims, 16 Drawing Sheets

CONNECTOR

BACKGROUND OF THE INVENTION

1. Field of the Invention

This invention relates to a connector for electrically connecting a plurality of card-type electronic devices to a printed circuit board.

2. Prior Art

Conventionally, there has been proposed a card connector provided with two housings and a plurality of electrically conductive terminals (see Publication of Japanese Utility Model Registration No. 3027049 (Paragraph numbers [0010], [0012], and [0014]).

The two housings are formed separately from each other, but have the same shape. Each housing is comprised of a base portion, and side portions continuously extending from opposite ends of the base portion at right angles to the base portion. Each housing is U-shaped in plan view. The two housings are stacked one upon another in a manner directed in the same direction, and are formed with an over-molded portion such that they are formed as a unitary member.

A latch piece is integrally formed with a foremost end of each side portion of each housing. The latch pieces are engaged with side edges of a card (card-type electronic device) to hold the card.

The electrically conductive terminals are arranged at the base portions of the two housings at a predetermined pitch.

Each electrically conductive terminal is comprised of a contact portion, an intermediate portion, and a solder tail. The contact portion is caused to face a card insertion hole formed in the base portion of each housing. The intermediate portion connects the contact portion and the solder tail. The intermediate portion of each electrically conductive terminal of the upper housing extends from an outer surface of the base portion of the upper housing, then bent toward the lower housing, and further bent at right angles at a location close to a lower surface of the lower housing to extend away from the outer surface of the base portion of the lower housing. The solder tail is formed on one end of the intermediate portion, and is bent into the shape of a crank. The intermediate portion of each electrically conductive terminal of the lower housing extends from the outer surface of the base portion thereof, bent toward the lower surface of the base portion thereof, bent again toward the base portion at right angles at a location close to the lower surface of the base portion, and extends through the base portion to protrude from an inner surface thereof. The solder tail is formed on one end of the intermediate portion, and is bent into the shape of a crank.

To load a card in the connector, first, a front end of the card is inserted into the card insertion hole in the base portion at a predetermined angle.

Then, the side edges of the card are caused to be engaged with the associated latch pieces while pivoting the card with the front end thereof as the center of pivotal motion such that the insertion angle is reduced. When the latch pieces are engaged with the side edges of the card, the card is locked, which completes the operation of loading the card.

On the other hand, to remove the card from the connector, it is only required to disengage the card from the latch pieces, pivot the card through an angle substantially equal to the above-described insertion angle in a direction opposite to the direction of pivotal motion during the loading operation, and then pull the front end of the card out of the insertion hole.

The above-described connector is advantageous for high density mounting, since two cards opposed to each other can be connected to the circuit board.

In the connector, however, the intermediate portions of the electrically conductive terminals arranged in the upper housing, and the intermediate portions of the electrically conductive terminals arranged in the lower housing are close to each other.

This makes it difficult to perform impedance matching between the electrically conductive terminals arranged in the upper housing and the electrically conductive terminals arranged in the lower housing.

SUMMARY OF THE INVENTION

The present invention has been made in view of these circumstances, and an object thereof is to provide a connector which enables effective use of space on a circuit board, and facilitates impedance matching between contacts.

To attain the above object, the present invention provides a connector comprising a first connector section mounted on a circuit board, for electrically connecting one of two card-type electronic devices opposed to each other with a predetermined gap therebetween, to the circuit board, and a second connector section mounted on the circuit board, for electrically connecting the other of the two card-type electronic devices to the circuit board, wherein the first connector section includes first contacts for electrically connecting a first terminal section disposed at a front end of the one card-type electronic device to the circuit board, and a first housing for holding the first contacts and supporting the first terminal section, and wherein the second connector section includes second contacts for electrically connecting a second terminal section disposed at a front end of the other card-type electronic device to the circuit board, and a second housing for holding the second contacts and supporting the second terminal section.

With the arrangement of the connector according to the present invention, the first connector section comprises the first housing for supporting the first terminal section of one card-type electronic device, and the first contacts held by the first housing, for electrically connecting the first terminal section to the circuit board, while the second connector section comprises the second housing for supporting the second terminal section of the other card-type electronic device, and the second contacts held by the second housing, for electrically connecting the second terminal section to the circuit board. Therefore, the two card-type electronic devices are connected to the circuit board by the first and second connectors in the state opposed to each other with the predetermined gap therebetween.

Further, the first contacts for electrically connecting the first terminal section of the one card-type electronic device to the circuit board are held by the first housing, and the second contacts for electrically connecting the second terminal section of the other card-type electronic device to the circuit board are held by the second housing. Therefore, the first contacts and the second contacts are spaced from each other. This facilitates impedance matching between the first and second contacts.

Thus, the present invention enables the effective use of the space on the circuit board and facilitates impedance matching between the contacts.

Preferably, the first connector section comprises a first locking device disposed in the first housing, for holding a rear end of the other card-type electronic device, the second connector section comprising a second locking device disposed in the second housing, for holding a rear end of the one card-type electronic device, the first locking device comprising a first locking section for engagement with the rear end of the other card-type electronic device supported by the first connector section, a first spring section disposed in the first housing, for urging the first locking section toward the rear end of the other card-type electronic device, and a first guide section disposed in the first housing, for engagement with the first spring section to restrict the first spring section from bending in directions other than directions along a plane of the circuit board, the second locking device comprising a second locking section for engagement with the rear end of the one card-type electronic device supported by the second connector section, a second spring section disposed in the second housing, for urging the second locking section toward the rear end of the one card-type electronic device, and a second guide section disposed in the second housing, for engagement with the second spring section to restrict the second spring sections from bending in directions other than directions along the plane of the circuit board.

More preferably, the connector further comprises an electrically conductive plate that can be disposed between the two card-type electronic devices.

More preferably, the plate is removably disposed in one of the first housing and the second housing.

More preferably, the plate is pivotally disposed in one of the first housing and the second housing.

Further preferably, the connector further comprises a conductive path for electrically connecting the plate and a ground pattern of the circuit board.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
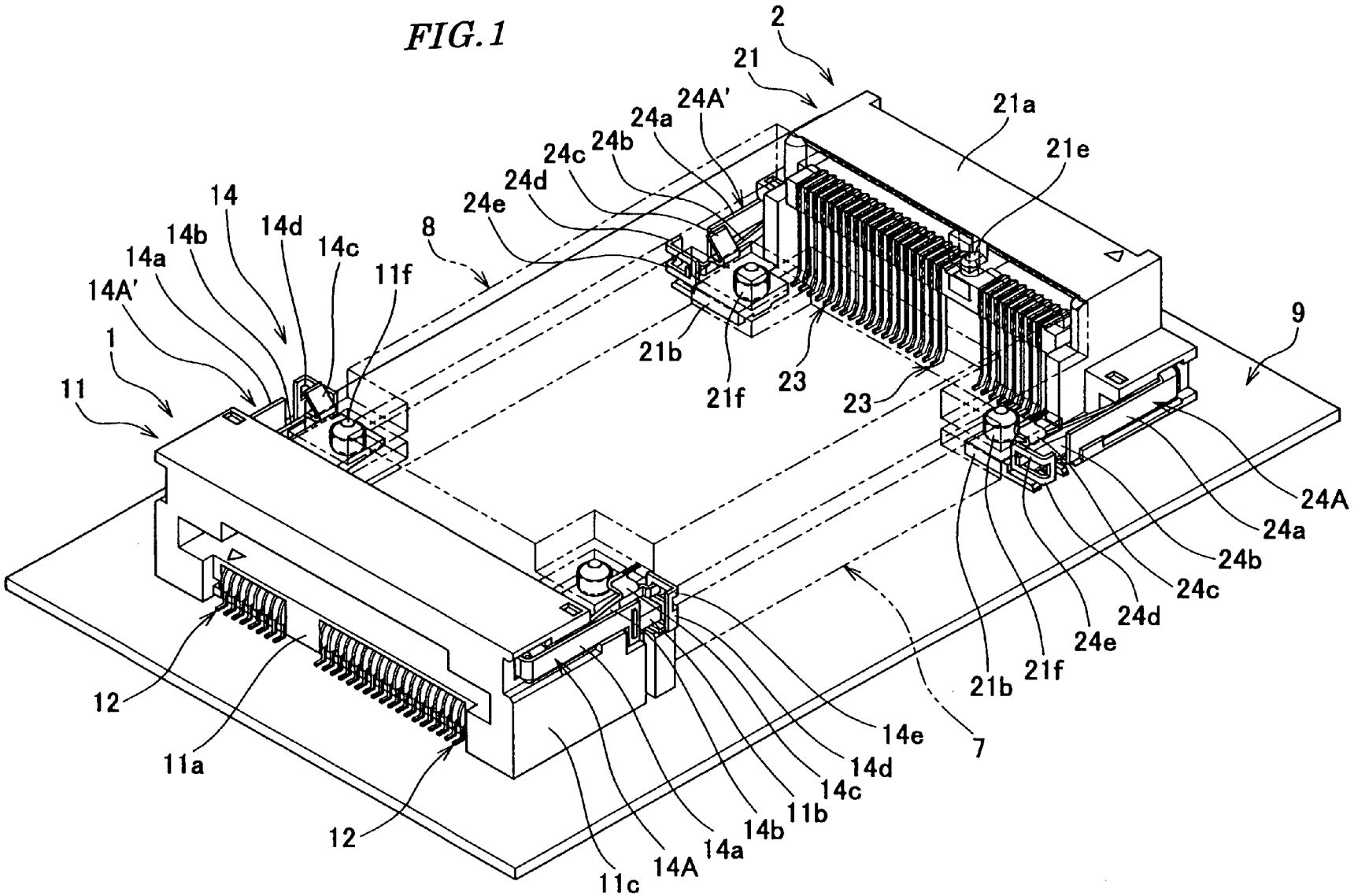
FIG. 1 is a perspective view of a card connector according to a first embodiment of the present invention, in a state loaded with first and second function expansion cards.
Figure 2:
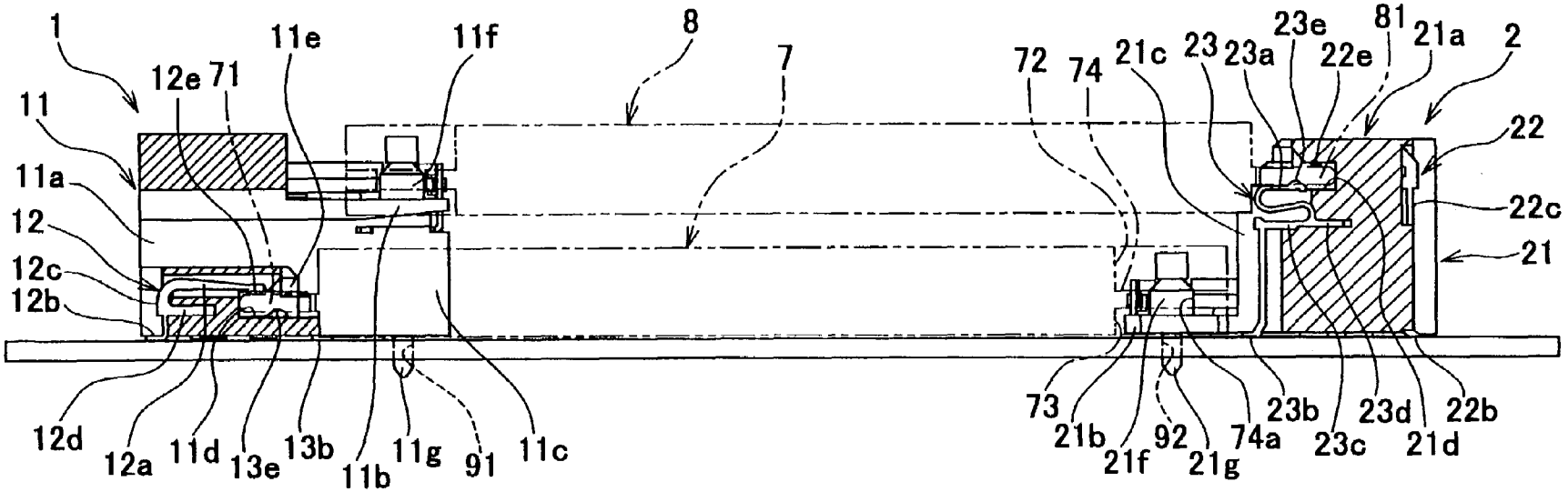
FIG. 2 is a cross-sectional view of the card connector in the same state as shown in FIG. 1.
Figure 3:
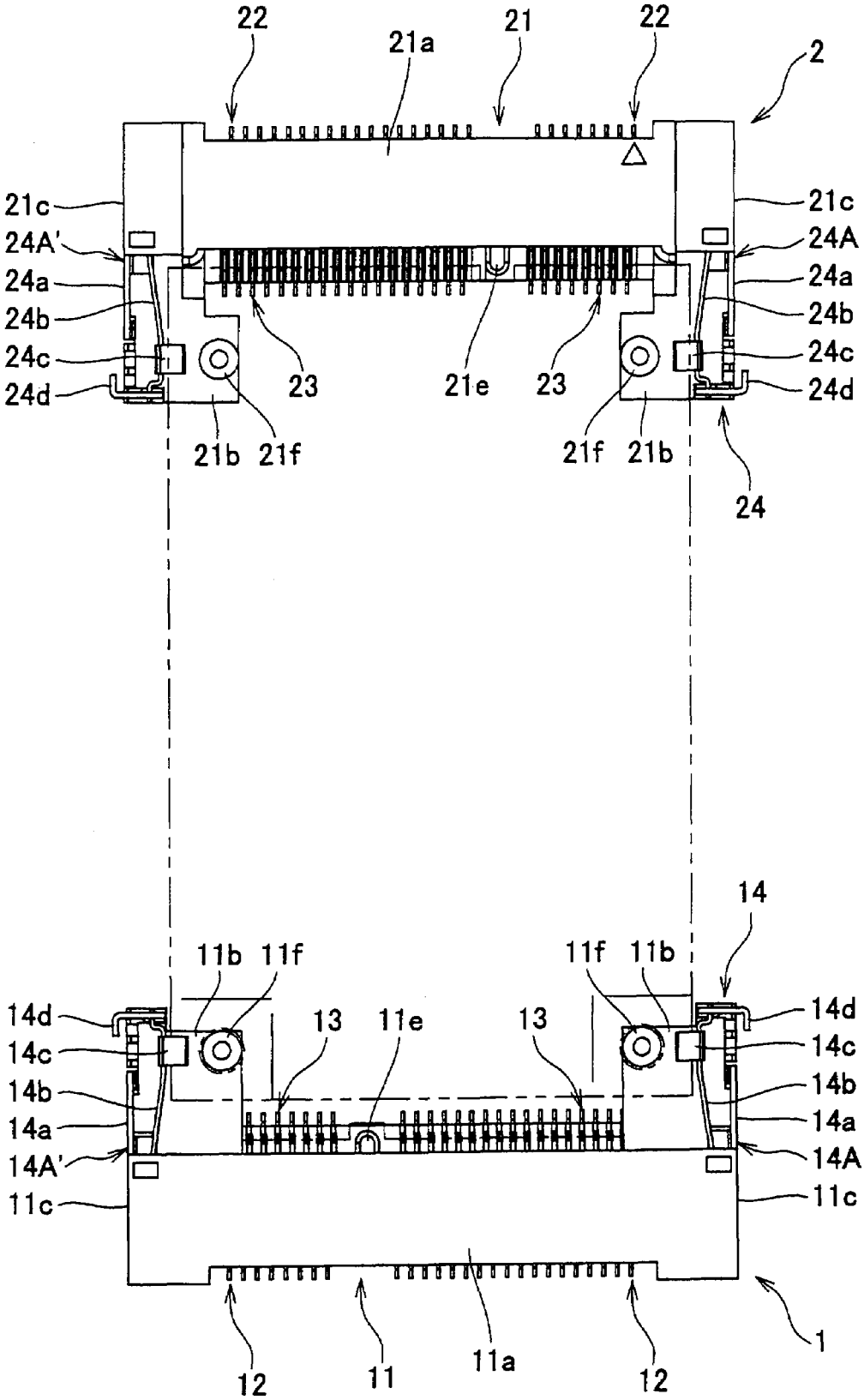
FIG. 3 is a plan view of the FIG. 1 card connector.
Figure 4:
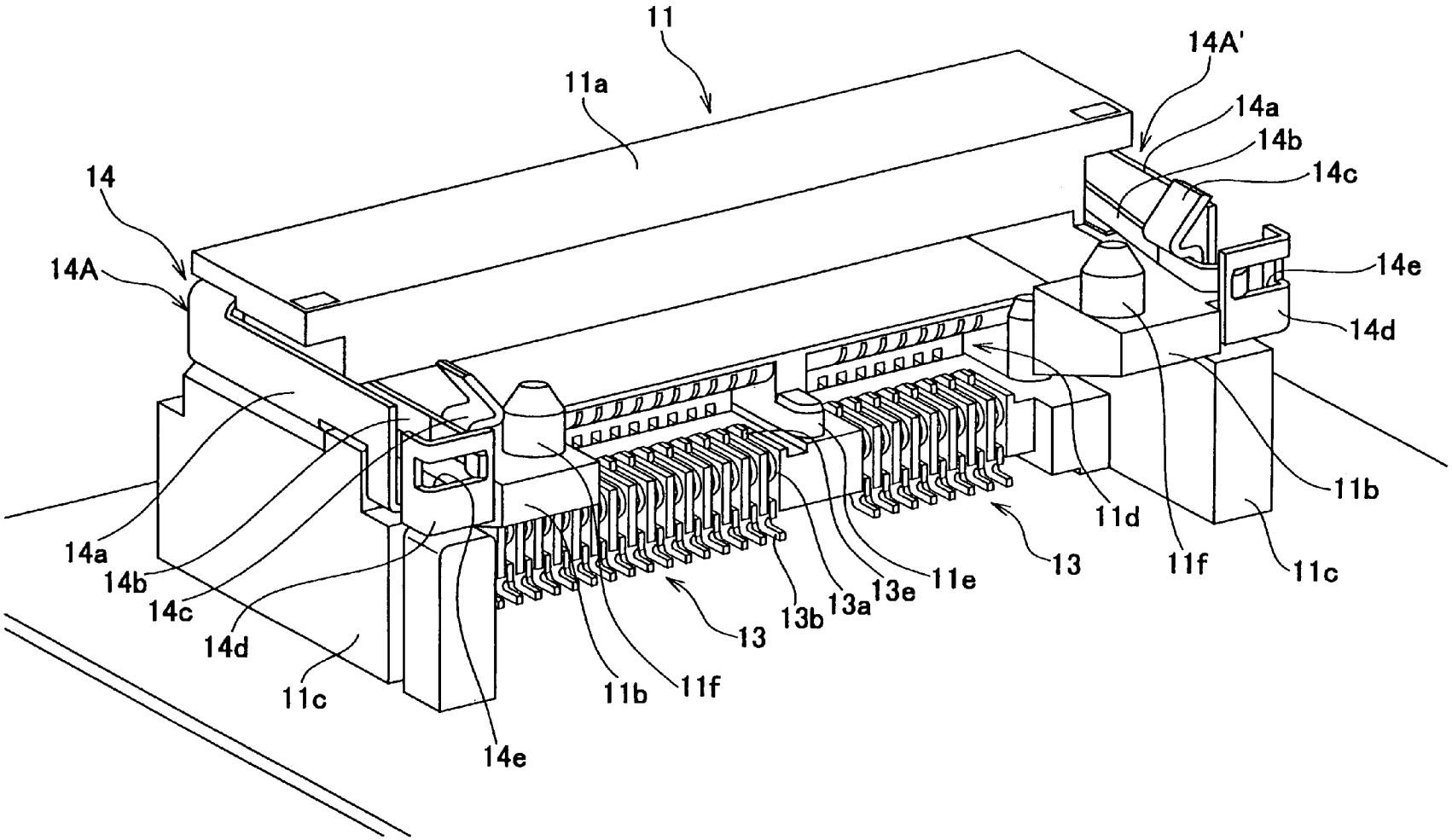
FIG. 4 is a perspective view of a first connector section of the FIG. 1 card connector.
Figure 5:
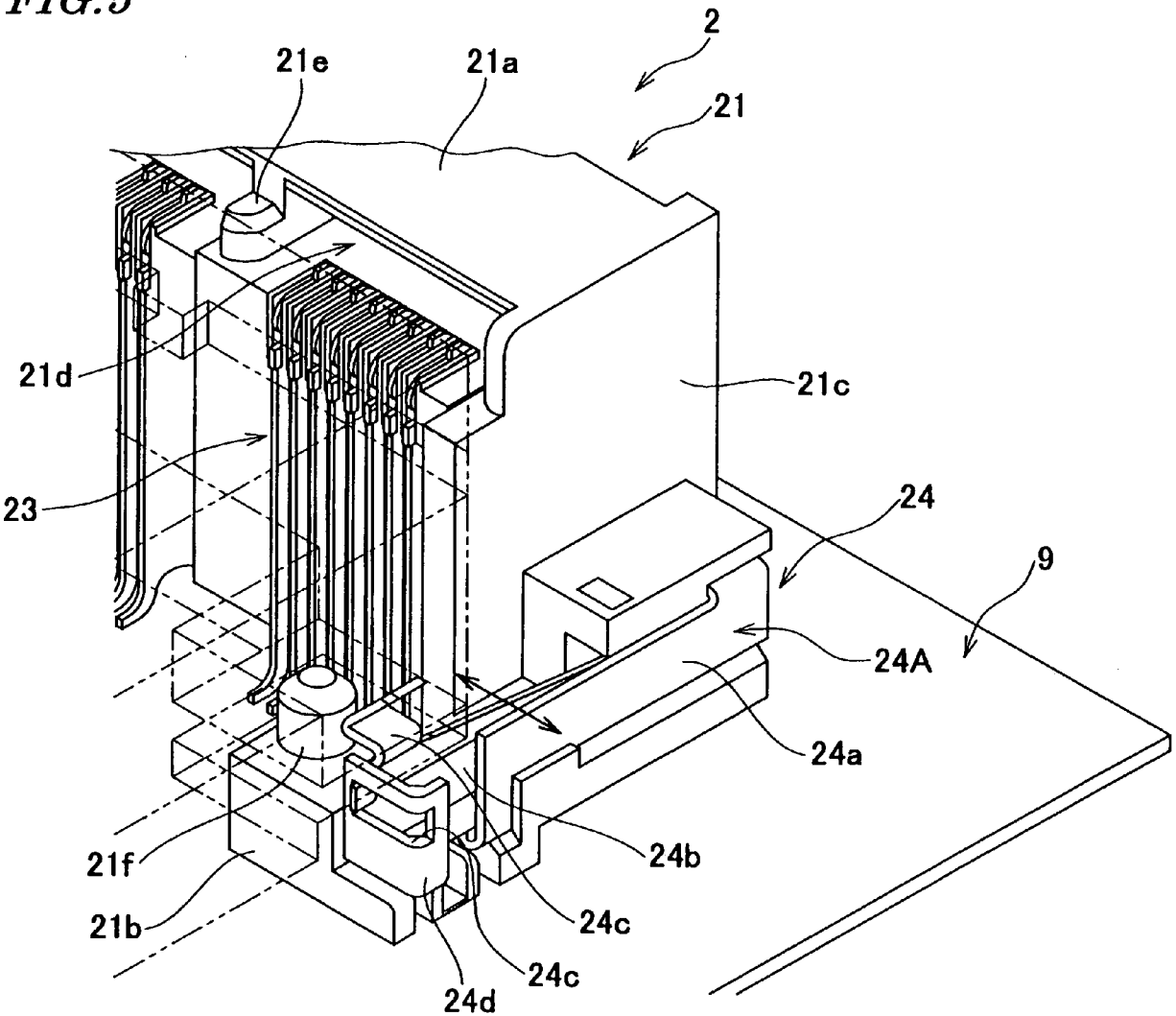
FIG. 5 is a perspective view of part of a second connector section of the FIG. 1 card connector.
Figure 6:
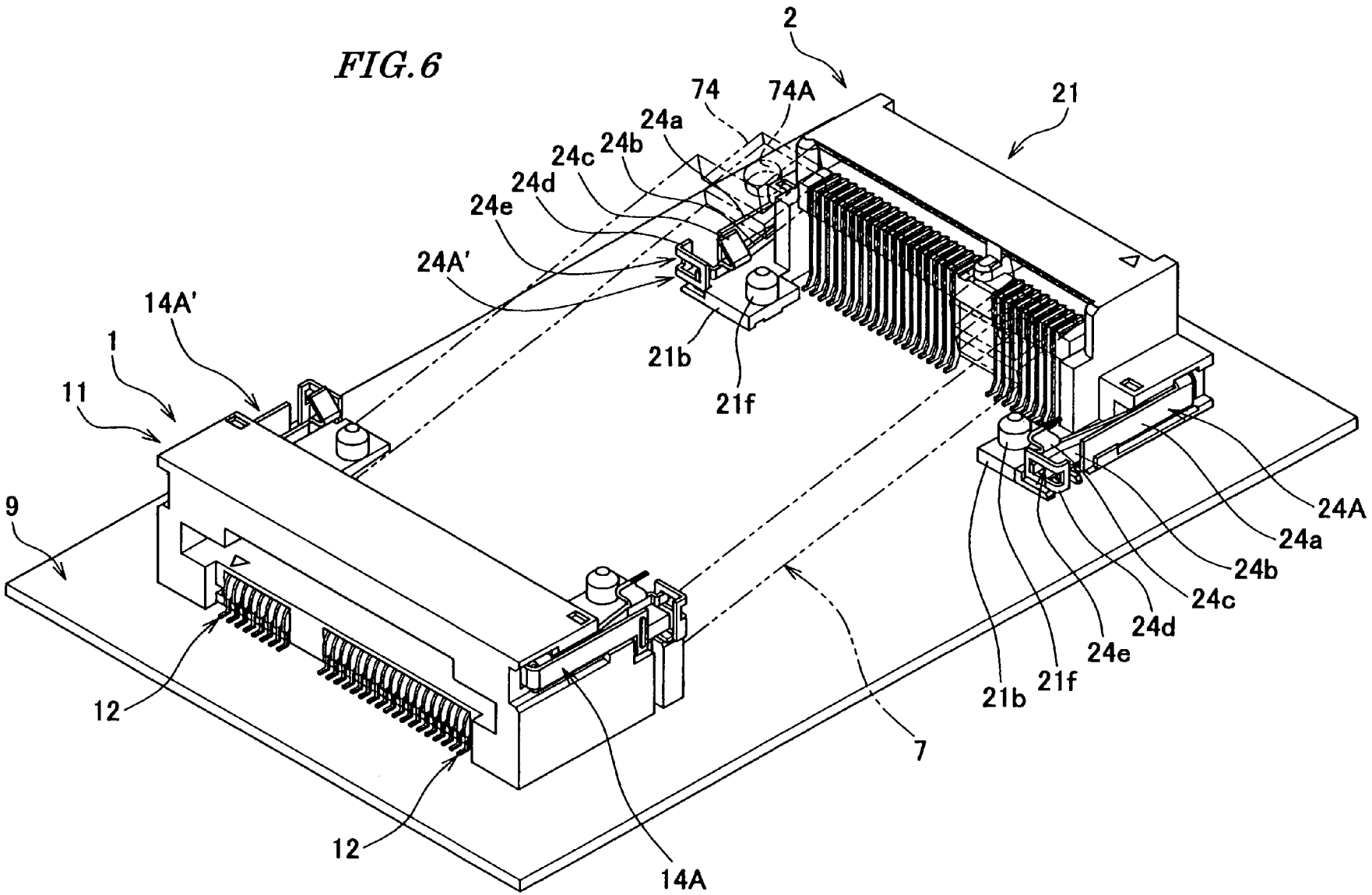
FIG. 6 is a perspective view of the card connector in a state in which a front end of the first function expansion card is inserted into the first connector section appearing in FIG. 1.
Figure 7:
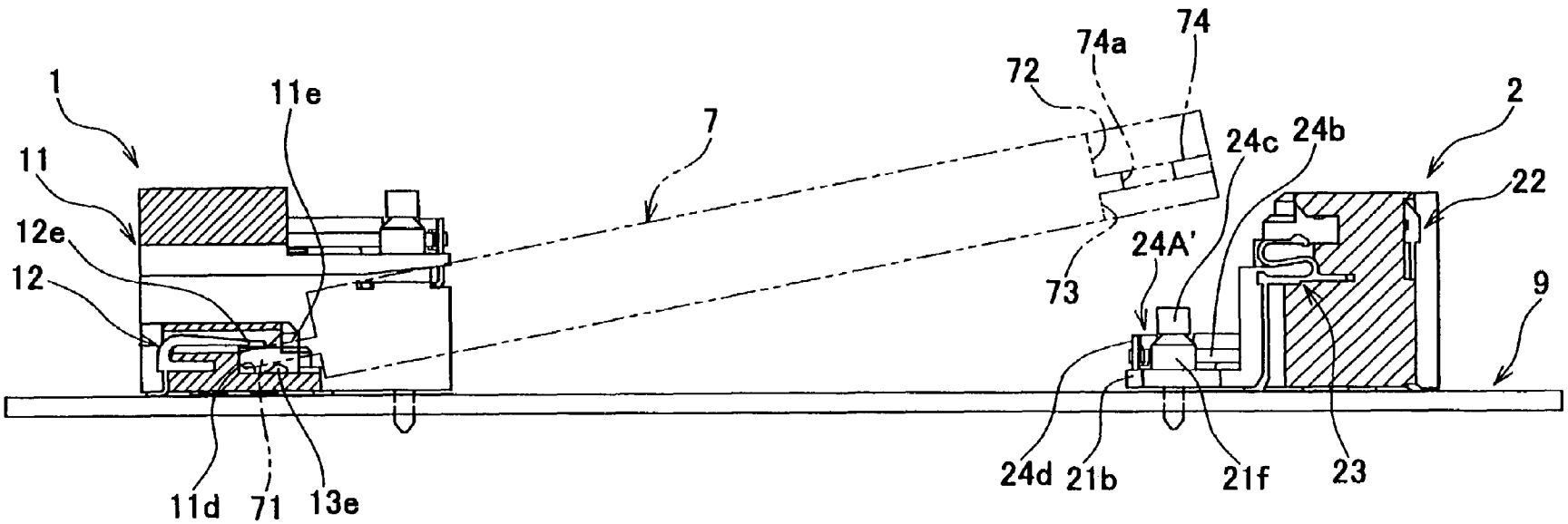
FIG. 7 is a cross-sectional view of the card connector in the same state as shown in FIG. 6.
Figure 8:
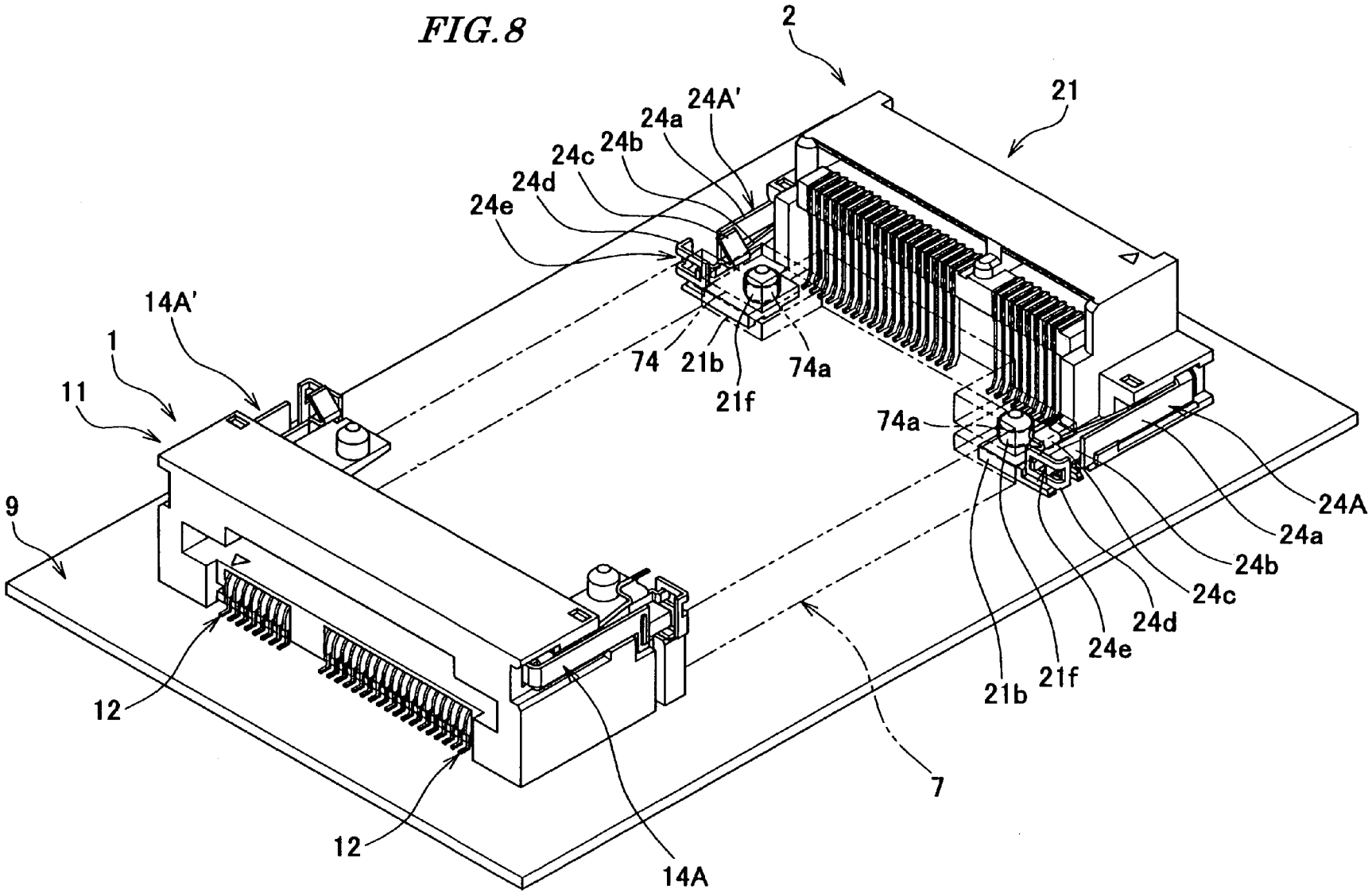
FIG. 8 is a perspective view of the card connector in a state in which a rear end of the first function expansion card is held by the second connector section of the card connector shown in FIG. 1.
Figure 9:
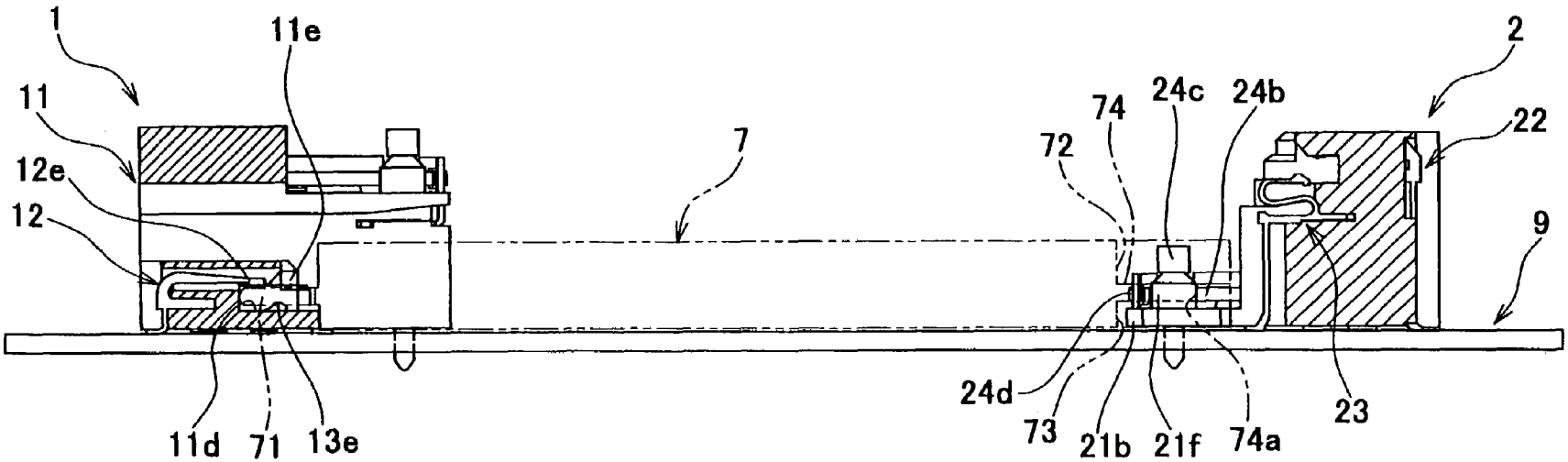
FIG. 9 is a cross-sectional view of the card connector in the same state as shown in FIG. 8.
Figure 10:
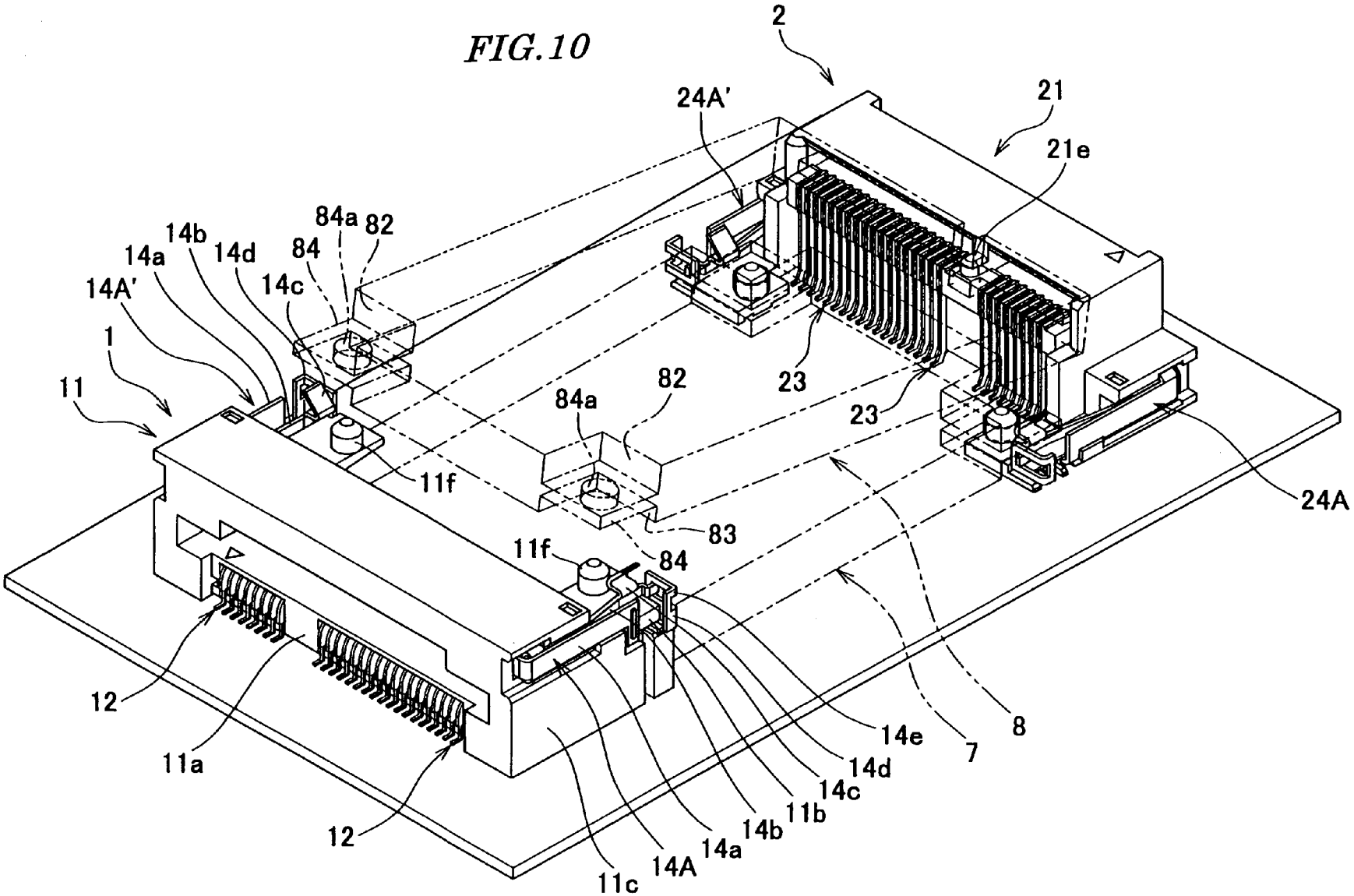
FIG. 10 is a perspective view of the card connector in a state in which a front end of the second function expansion card is inserted into the second connector section of the card connector appearing in FIG. 1.
Figure 11:
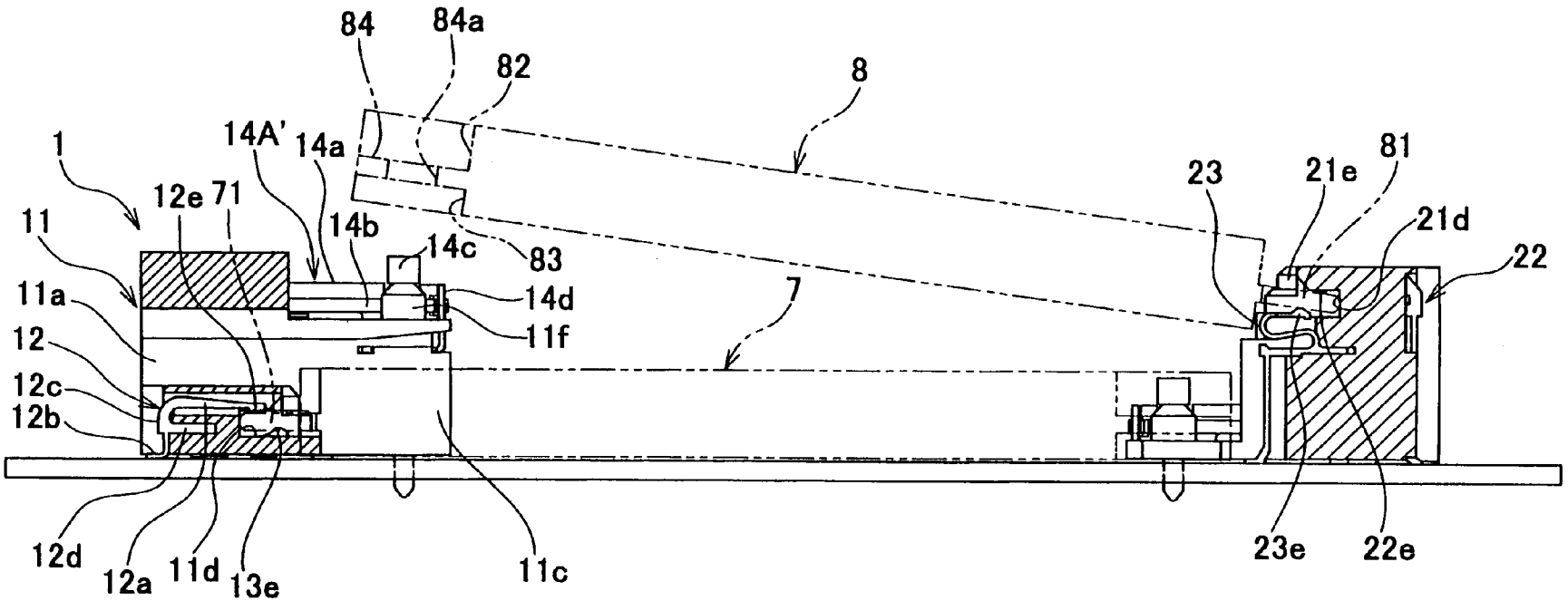
FIG. 11 is a cross-sectional view of the card connector in the same state as shown in FIG. 10.

FIG. 1 is a perspective view of a card connector according to a first embodiment of the present invention, in a state loaded with first and second function expansion cards. FIG. 2 is a cross-sectional view of the card connector in the same state as shown in FIG. 1. FIG. 3 is a plan view of the FIG. 1 card connector. FIG. 4 is a perspective view of a first connector section of the FIG. 1 card connector. FIG. 5 is a perspective view of part of a second connector section of the FIG. 1 card connector. FIG. 6 is a perspective view of a card connector in a state in which the front end of the first function expansion card is inserted into the first connector section appearing in FIG. 1. FIG. 7 is a cross-sectional view of the card connector in the same state as shown in FIG. 6. FIG. 8 is a perspective view of the card connector in a state in which a rear end of the first function expansion card is held by the second connector section of the card connector in FIG. 1. FIG. 9 is a cross-sectional view of the card connector in the same state as shown in FIG. 8. FIG. 10 is a perspective view of the card connector in a state in which a front end of the second function expansion card is inserted into the second connector section of the card connector appearing in FIG. 1. FIG. 11 is a cross-sectional view of the card connector in the same state as shown in FIG. 10.

Referring to FIGS. 1 to 5, the card connector (connector) is for electrically connecting the first function expansion card (card-type electronic device) 7 and the second function expansion card (the other card-type electronic device) 8, which are arranged in a manner opposed to each other with a predetermined gap therebetween, to a printed wiring board (circuit board) 9, and is mounted on the printed wiring board 9.

The first function expansion card 7 has a front end provided with a terminal section (first terminal section) 71. The terminal section 71 has a plurality of terminals, not shown, provided on upper and lower surfaces thereof. A rear end of the first function expansion card 7 has recesses 72 and 73 formed in respective upper and lower surfaces of each of opposite corners thereof. The recesses 72 and 73 are in a front-back positional relationship with respect to thin portions 74 therebetween (see FIGS. 6 and 7). Each recess 72 receives a second locking device 24, described hereinafter, and each recess 73 receives a support plate 21*b*, described hereinafter. Each thin portion 74 is formed with a positioning hole 74*a*.

The standard on the second function expansion card 8 is the same as that on the first function expansion card 7, and the outer shape of the second function expansion card 8 is the same as that of the first function expansion card 7. Therefore, similarly to the first function expansion card 7, the second function expansion card 8 has a terminal section (second terminal section) 81, recesses 82 and 83, and thin portions 84 (see FIGS. 10 and 11). The terminal section 81 has a plurality of terminals, not shown, provided on respective upper and lower surfaces thereof. Each recess 82 receives a first locking device 14, described hereinafter, and each recess 83 receives a support plate 11*b*, described hereinafter. Each thin portion 84 is formed with a positioning hole 84*a*.

The card connector includes the first connector section 1 and the second connector section 2.

The first connector section 1 is comprised of a first housing 11, a plurality of upper contacts (first contacts) 12, a plurality of lower contacts (first contacts) 13, and the first locking device 14. The first connector section 1 electrically connects the first function expansion card 7 to the printed wiring board 9.

The first housing 11 includes a housing body 11*a*, the support plates 11*b* (first support section), and side walls 11*c*.

The housing body 11*a* has a lower portion thereof (portion toward the printed wiring board 9) formed with a receiving hole 11*d* for receiving the terminal section 71 of the first function expansion card 7. Further, the housing body 11*a* is formed with a key 11*e*, for preventing wrong fitting of the first function expansion card 7. The support plates 11*b* are formed on a front surface of the housing body 11*a*, and positioned above the receiving hole 11*d*, as viewed in FIG. 4. The support plates 11*b* support the thin portions 84 of the second function expansion card 8, respectively. Each support plate 11*b* has a positioning boss 11*f* formed on an upper surface thereof. The positioning bosses 11*f* are inserted into respective positioning holes 84*a* of the thin portions 84. The side walls 11*c* are provided on side surfaces of the housing body 11*a*. Each side wall 11*c* has a positioning pin 11*g* formed on a lower surface thereof. The positioning pins 11*g* are inserted into positioning holes 91 of the printed wiring board 9.

The upper contacts 12 are arranged at equal spaced intervals on the housing body 11*a*. Each upper contact 12 includes a spring section 12*a*, a terminal section 12*b*, a connecting portion 12*c*, a press-fitting portion 12*d*, and a contact 12*e*.

The spring section 12*a* has a substantially belt-like shape, and has a foremost end thereof facing the receiving hole 11*d*. The terminal section 12*b* is exposed toward a back side of the housing body 11*a*, and is soldered to a pad, not shown, of the printed wiring board 9. The connecting portion 12*c* has a substantially belt-like shape, and connects the spring section 12*a* and the terminal section 12*b*. One end of the press-fitting portion 12*d* is connected to the connecting portion 12*c*, and the other end thereof is press-fitted into the housing body 11*a*. The contact 12*e* is connected to the foremost end of the spring section 12*a*. The contact 12*e* is urged against a terminal on an upper surface of the terminal section 71 of the first function expansion card 7 inserted into the receiving hole 11*d*, by the spring section 12*a*.

The lower contacts 13 are constructed similarly to lower contacts 23, described hereinafter, of the second connector section 2, and are arranged at equal spaced intervals on the housing body 11*a*. Each lower contact 13 includes a spring section 13*a*, a terminal section 13*b*, a connecting portion, not shown, a press-fitting portion, not shown, and a contact 13*e*.

The foremost end of the spring section 13*a* is located in the receiving hole 11*d*. The terminal section 13*b* is exposed toward a front side of the housing body 11*a*, and is soldered to a pad, not shown, of the printed wiring board 9. The connecting portion connects the spring section 13*a* and the terminal section 13*b*. The press-fitting portion is connected to the connecting portion, and is press-fitted into the housing body 11*a*. The contact 13*e* is connected to the foremost end of the spring section 13*a*. The contact 13*e* is pressed against a terminal on a lower surface of the terminal section 71 of the first function expansion card 7 inserted into the receiving hole 11*d* by the spring section 13*a*.

The first locking device 14 is comprised of a pair of locking members 14A and 14A'.

The locking member 14A is formed by blanking and bending a piece of metal sheet. The locking member 14A includes an arm section 14*a*, a spring section 14*b*, a locking section 14*c*, and a guide section 14*d*. The arm section 14*a* has a substantially belt-like shape, and is fixed to the first housing 11. The spring section 14*b* has a substantially belt-like shape, and has one end thereof connected to the arm section 14*a*. The spring section 14*b* resiliently moves along the arrangement direction of the upper contacts 12. The locking section 14*c* is generally L-shaped, and is connected to the other end of the spring section 14*b*. The locking section 14*c* is engaged with an associated one of the thin portions 84 of the second function expansion card 8. The locking section 14*c* is urged by the spring section 14*b* such that the locking section 14*c* is not easily disengaged from the thin portion 84. Further, the locking section 14*c* prevents the rear end of the second function expansion card 8 from being lifted together with the spring section 14*b*. The guide section 14*d* is connected to the arm section 14*a* by a portion thereof not appearing in the figures. The guide section 14*d* includes a window hole 14*e*. The other end of the spring section 14*b* is inserted into the window hole 14*e*. The window hole 14*e* of the guide section 14*d* guides the other end of the spring section 14*b* in the arrangement direction of the upper contacts 12, to thereby prevent the spring section 14*b* from moving in a direction different from the arrangement direction of the upper contacts 12.

Since the locking member 14A' is constructed similarly to the locking member 14A, component parts thereof identical to those of the locking member 14A are designated by the same reference numerals, and detailed description thereof is omitted.

The second connector section 2 is comprised of a second housing 21, a plurality of upper contacts (second contacts) 22, a plurality of lower contacts (second contacts) 23, and the second locking device 24, and electrically connects the second function expansion card 8 to the printed wiring board 9.

The second housing 21 includes a housing body 21*a*, the support plates 21*b* (second support section), and side walls 21*c*.

The housing body 21*a* has an upper portion thereof (portion opposite from the printed wiring board 9) formed with a receiving hole 21*d* for receiving the terminal section 81 of the second function expansion card 8. Further, The housing body 21*a* is formed with a key 21*e* for preventing wrong fitting of the second function expansion card 8 (see FIG. 3). The support plates 21*b* are formed on a front surface of the housing body 21*a*, and are located below the receiving hole 21*d*, as viewed in FIG. 5. The support plates 21*b* support the thin portions 74 of the first function expansion card 7, respectively. Each support plate 21*b* has a positioning boss 21*f* formed on an upper surface thereof. The positioning bosses 21*f* are inserted into respective positioning holes 74*a* of the thin portions 74. Each support plate 21*b* has a positioning pin 21*g* formed on a lower surface thereof. The positioning pins 21*g* are inserted into positioning holes 92 of the printed wiring board 9, respectively. The side walls 21*c* are provided on lateral sides of the housing body 21*a*, respectively.

The upper contacts 22 are constructed similarly to the upper contacts 12 of the first connector section 1, and are arranged at equal spaced intervals on the housing body 21*a* (see FIG. 2). Each upper contact 22 includes a spring section, not shown, a terminal section 22*b*, a connecting portion 22*c*, a press-fitting portion, not shown, and a contact 22*e*.

The foremost end of the spring section is located in the receiving hole 21*d*. The terminal section 22*b* is exposed toward a back surface of the housing body 21*a*, and is soldered to a pad, not shown, of the printed wiring board 9. The connecting portion 22*c* connects the spring section and the terminal section 22*b*. One end of the press-fitting portion is connected to the connecting portion 22*c*, and the other end thereof is press-fitted into the housing body 21*a*. The contact 22*e* is connected to the foremost end of the spring section. The contact 22*e* is urged against a terminal on an upper surface of the terminal section 81 of the second function expansion card 8 inserted into the receiving hole 21*d*, by the spring section.

The lower contacts 23 are arranged at equal spaced intervals on the housing body 21*a*. Each lower contact 23 includes a spring section 23*a*, a terminal section 23*b*, a connecting portion 23*c*, a press-fitting portion 23*d*, and a contact 23*e*.

The spring section 23*a* is S-shaped, and the foremost end thereof is located in the receiving hole 11*d*. The terminal section 23*b* is exposed toward the front surface of the housing body 21*a*, and is soldered to a pad, not shown, of the printed wiring board 9. The connecting portion 23*c* is L-shaped, and connects the spring section 23*a* and the terminal section 23*b*. The press-fitting portion 23*d* is connected to a portion connecting between the spring section 23*a* and the connecting portion 23*c*, and is press-fitted into the housing body 21*a*. The contact 23*e* is urged against a terminal on a lower surface of the terminal section 81 of the second function expansion card 8 inserted into the receiving hole 21*d*, by the spring section 23*a*.

The second locking device 24 is comprised of a pair of locking members 24A and 24A'.

The locking member 24A is formed by blanking and bending a piece of metal sheet. The locking member 24A includes an arm section 24*a*, a spring section 24*b*, a locking section 24*c*, and a guide section 24*d*. The arm section 24*a* has a substantially belt-like shape, and is fixed to the second housing 21. The spring section 24*b* has a substantially belt-like shape, and has one end thereof connected to the arm section 24*a*. The spring section 24*b* resiliently moves along the arrangement direction of the lower contacts 23. The locking section 24*c* is generally L-shaped, and is connected to the other end of the spring section 24*b*. The locking section 24*c* is engaged with an associated one of the thin portions 74 of the first function expansion card 7. The locking section 24*c* is urged by the spring section 24*b* such that the locking section 24*c* is not easily disengaged from the thin portion 74. Further, the locking section 24*c* prevents the rear end of the first function expansion card 7 from being lifted together with the spring section 24*b*. The guide section 24*d* is connected to the arm section 24*a* by a portion thereof not appearing in the figures. The guide section 24*d* includes a window hole 24*e*. The other end of the spring section 24*b* is inserted into the window hole 24*e*. The window hole 24*e* of the guide section 24*d* guides the other end of the spring section 24*b* in the arrangement direction of the lower contacts 23, to thereby prevent the spring section 24*b* from moving in a direction different from the arrangement direction of the lower contacts 23.

Since the locking member 24A' is constructed similarly to the locking member 24A, component parts thereof identical to those of the locking member 24A are designated by the same reference numerals, and detailed description thereof is omitted.

Next, a description will be given of a method of using the card connector.

First, the first connector section 1 and the second connector section 2 are mounted on predetermined positions of the printed wiring board 9.

Then, as shown in FIGS. 6 and 7, the terminal section 71 of the first function expansion card 7 is inserted into the receiving hole 11*d* of the first connector section 1. At this time, if the terminal section 71 is accurately inserted into the receiving hole 11*d*, the key 11*e* is relatively inserted into a cutout, not shown, formed in the terminal section 71, to allow the terminal section 71 to be deeply inserted into the receiving hole 11*d*. If the terminal section 71 is not accurately inserted into the receiving hole 11*d*, the terminal section 71 abuts against the key 11*e*, and is not allowed to be inserted deeply into the receiving hole 11*d*, whereby wrong fitting of the first function expansion card 7 is prevented.

After that, the first function expansion card 7 is pivoted clockwise with the terminal section 71 of the first function expansion card 7 as the center of pivotal motion. At this time, the positioning bosses 21*f* of the second connector section 2 are inserted into the positioning holes 74*a* of the first function expansion card 7, whereby the first function expansion card 7 is positioned.

When the positioning bosses 21*f* of the second connector section 2 are inserted into the positioning holes 74*a* of the first function expansion card 7, as shown in FIGS. 8 and 9, the locking sections 24*c* of the second locking device 24 of the second connector section 2 are engaged with the thin portions 74 of the first function expansion card 7, to thereby lock the first function expansion card 7.

As a result, the first function expansion card 7 is held by the first and second connector sections 1 and 2, and the terminals of the terminal section 71 of the first function expansion card 7 are electrically connected to the printed wiring board 9 via the upper contacts 12 and the lower contacts 13 of the first connector section 1.

So long as the first function expansion card 7 is held by the first and second connector sections 1 and 2, even when an external force is applied to the first function expansion card 7, for lifting the rear end of the first function expansion card 7, the guide sections 24*d* prevent the spring sections 24*b* and the locking sections 24*c* from being lifted.

Then, as shown in FIGS. 10 and 11, the terminal section 81 of the second function expansion card 8 is inserted into the receiving hole 21*d* of the second connector section 2. At this time, if the terminal section 81 is accurately inserted into the receiving hole 21*d*, the key 21*e* is relatively inserted into a cutout, not shown, formed in the terminal section 81, to allow the terminal section 81 to be deeply inserted into the receiving hole 21*d*. If the terminal section 81 is not accurately inserted into the receiving hole 21*d*, the terminal section 81 abuts against the key 21*e*, and is not allowed to be deeply inserted into the receiving hole 21*d*, whereby wrong fitting of the second function expansion card 8 is prevented.

After that, the second function expansion card 8 is pivoted counterclockwise with the terminal section 81 of the second function expansion card 8 as the center of pivotal motion. At this time, the positioning bosses 11*f* of the first connector section 1 are inserted into the positioning holes 84*a* of the second function expansion card 8, whereby the second function expansion card 8 is positioned.

When the positioning bosses 11*f* of the first connector section 1 are inserted into the positioning holes 84*a* of the second function expansion card 8, as shown in FIGS. 1 and 2, the locking sections 14*c* of the first locking device 14 of the first connector section 1 are engaged with the thin portions 84 of the second function expansion card 8, to thereby lock the first function expansion card 7.

As a result, the second function expansion card 8 is held by the first and second connector sections 1 and 2, and the terminals of the terminal section 81 of the second function expansion card 8 are electrically connected to the printed wiring board 9 via the upper contacts 22 and the lower contacts 23 of the second connector section 2.

When the second function expansion card 8 is held by the first and second connector sections 1 and 2, even if an external force is applied to the second function expansion card 8, for lifting the rear end of the second function expansion card 8, the guide sections 14*d* prevent the spring sections 14*b* and the locking sections 14*c* from being lifted.

Next, a description will be given of the operation of removing the first and second function expansion cards 7 and 8 from the card connector.

First, to remove the second function expansion card 8, the locking sections 14*c* of the first locking device 14 of the first connector section 1 are widened both leftward and rightward, as viewed in FIG. 3, whereby the locking sections 14*c* are disengaged from the thin portions 84 of the second function expansion card 8.

Then, as shown in FIGS. 10 and 11, the second function expansion card 8 is pivoted clockwise with the terminal section 81 of the second function expansion card 8 as the center of pivotal motion, and then the second function expansion card 8 is pulled out from the receiving hole 21*d*.

To remove the first function expansion card 7, the locking sections 24*c* of the second locking device 24 of the second connector section 2 are widened leftward and rightward, as viewed in FIG. 3, whereby the locking sections 24*c* are pulled out from the thin portions 74 of the first function expansion card 7.

Then, as shown in FIGS. 6 and 7, the first function expansion card 7 is pivoted counterclockwise with the terminal section 71 of the first function expansion card 7 as the center of pivotal motion, and then the first function expansion card 7 is pulled out from the receiving hole 11*d*.

According to the present embodiment, the two function expansion cards 7 and 8 can be connected to the printed wiring board 9 in the state opposed to each other, whereby it is possible to effectively use the space on the printed wiring board 9 and at the same time arrange the contacts 12 and 13 and the contacts 22 and 23 in a state spaced from other. This facilitates impedance matching between the contacts 12 and 13 and the contacts 22 and 23

Further, by arranging the guide sections 14*d* and 24*d*, it is possible to prevent the locking sections 14*c* and 24*c* from being easily disengaged from the thin portions 74 and 84 of the function expansion cards 7 and 8, and prevent deformation of the spring sections 14*b* and 24*b* since the guide sections 14*d* and 24*d* restrict bending of the spring sections 14*b* and 24*b* in directions other than the planar direction of the printed wiring board 9.

Figure 12:
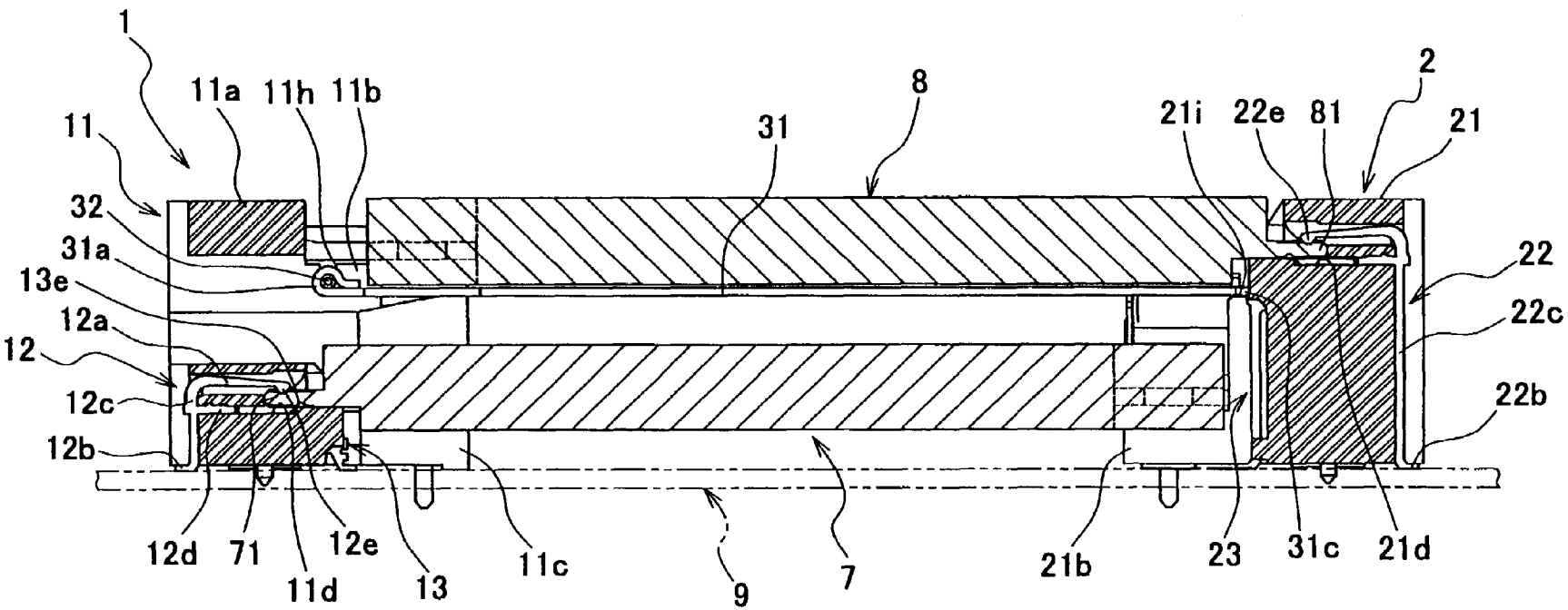
FIG. 12 is a cross-sectional view of a card connector according to a second embodiment of the present invention in a state in which the card connector is loaded with first and second function expansion cards.
Figure 13A:
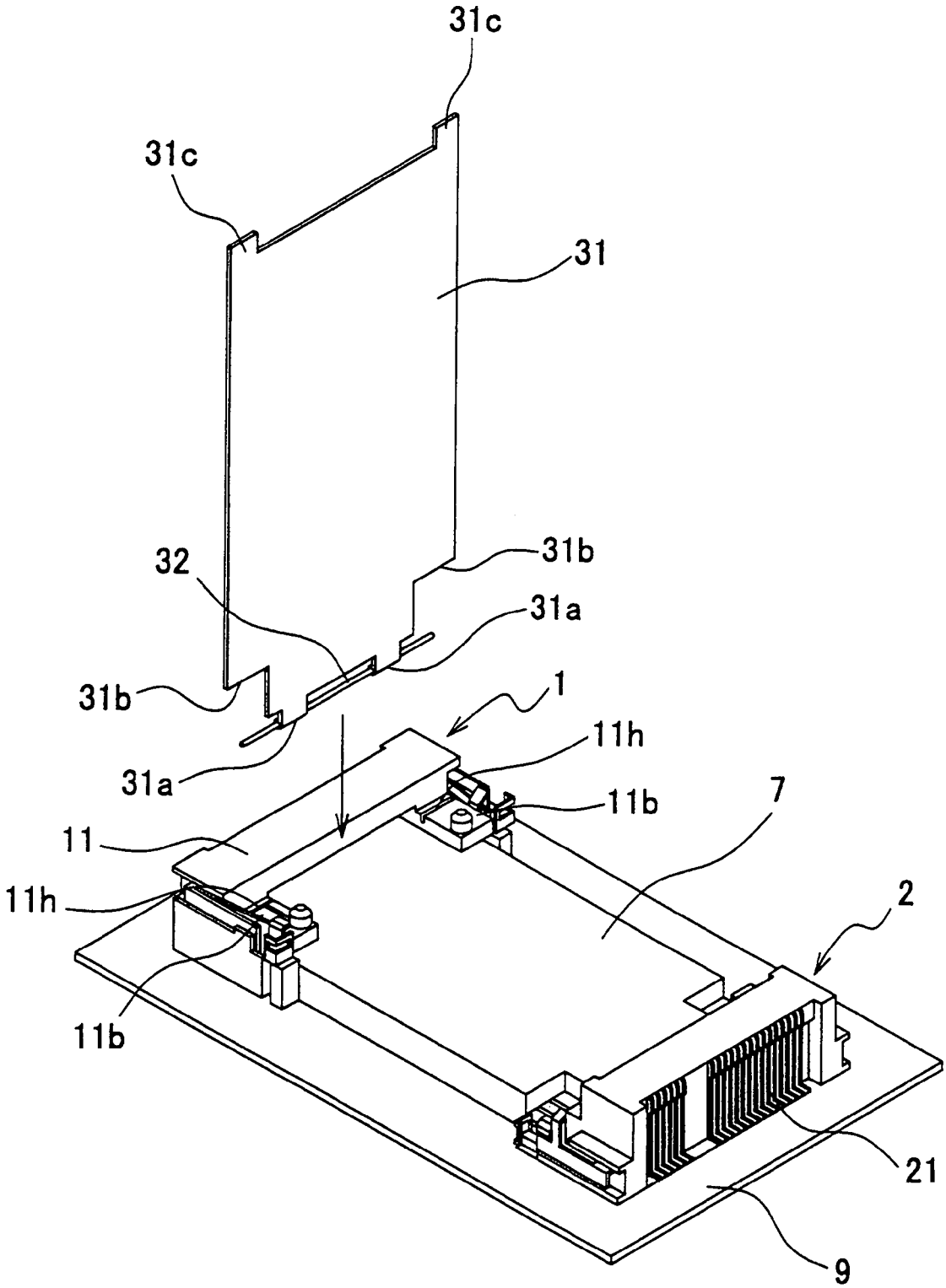
FIG. 13A is a perspective view of the FIG. 12 connector in a state in which a ground plate is disposed above the first connector section.
Figure 13B:
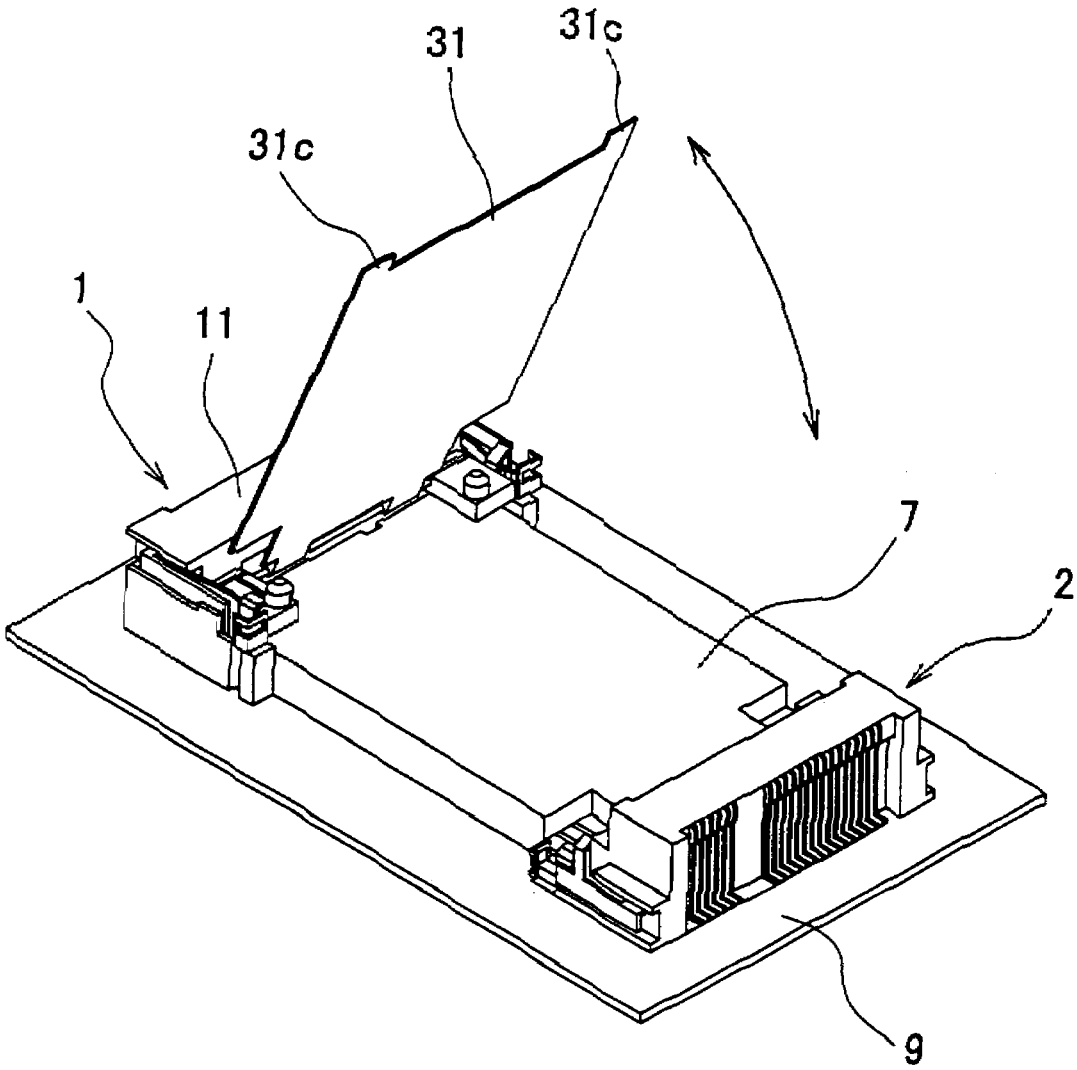
FIG. 13B is a perspective view of the FIG. 12 connector in a state in which a shaft is inserted into groves of the first housing.
Figure 13C:
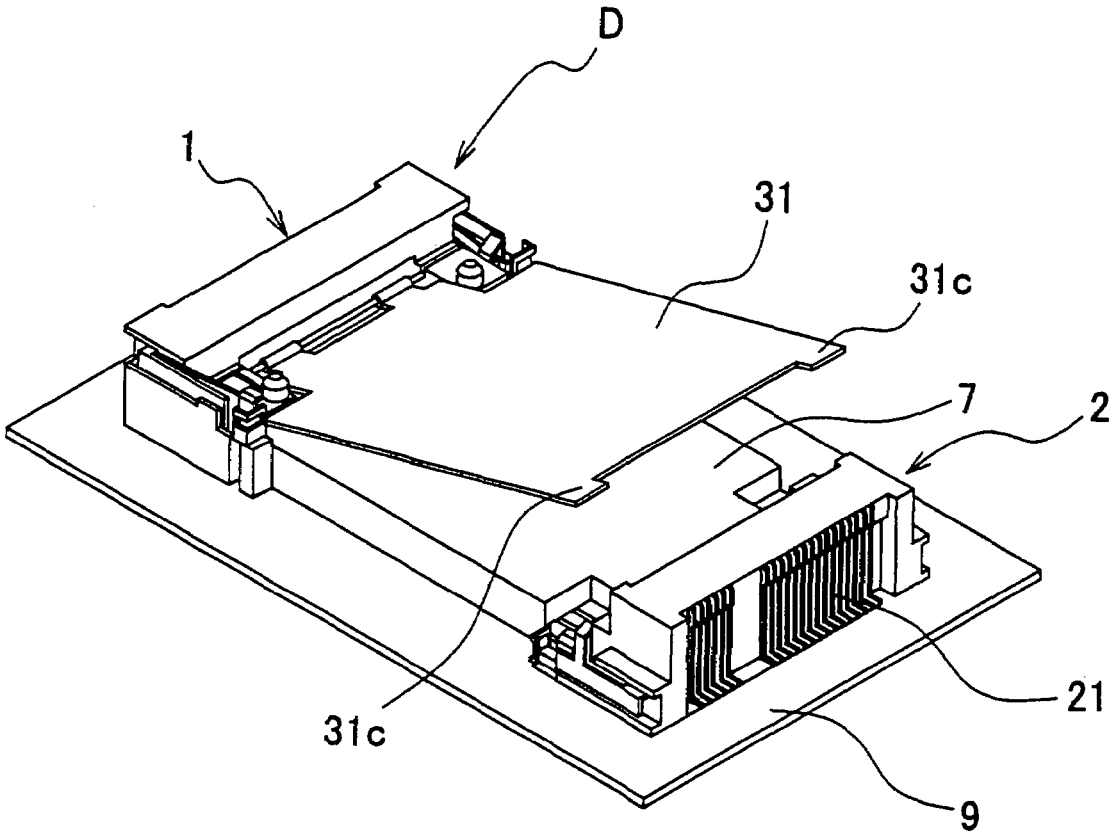
FIG. 13C is a perspective view of the FIG. 12 connector in a state in which the ground plate is pivoted toward the circuit board.
Figure 13D:
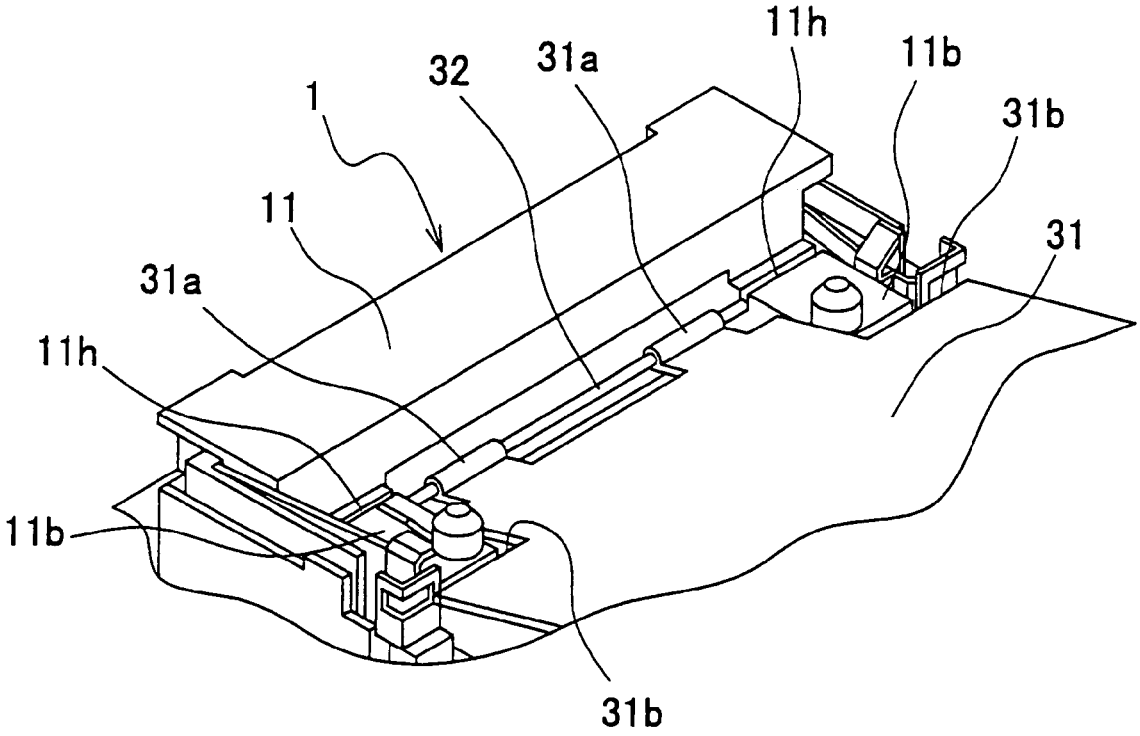
FIG. 13D is an enlarged view of part D appearing in FIG. 13C.

FIG. 12 is a cross-sectional view of a card connector according to a second embodiment of the present invention in a state in which the card connector is loaded with the first and second function expansion cards. FIGS. 13A to 13D are diagrams showing the FIG. 12 connector and a ground plate, in a state in which the ground plate is about to be mounted on the connector, in which: FIG. 13A is a perspective view of the FIG. 12 connector in a state in which a ground plate is disposed above the first connector section. FIG. 13B is a perspective view of the FIG. 12 connector in a state in which a shaft is inserted into groves of the first housing. FIG. 13C is a perspective view of the FIG. 12 connector in a state in which the ground plate is pivoted toward the circuit board. FIG. 13D is an enlarged view of part D appearing in FIG. 13C. Component parts identical to those of the card connector according to the first embodiment are designated by identical reference numerals, and detailed description thereof is omitted, while only main component parts different in construction from those of the first embodiment will be described hereinafter.

Referring to FIG. 12, in the connector according to the second embodiment, the first connector section is provided with the ground plate (plate) 31. When the first and second function expansion cards 7 and 8 are electrically connected to the printed wiring board 9 by the first and second connector sections 1 and 2, the ground plate 31 exist between the first function expansion card 7 and the second function expansion card 8.

The ground plate 31 is an electrically conductive metal plate. The area of the ground plate 31 is substantially equal to those of the first and second function expansion cards 7 and 8. The ground plate 31 has one end thereof formed with a pair of hollow cylindrical shaft-holding portions 31*a*. A shaft 32 is inserted through the pair of hollow cylindrical shaft-holding portions 31*a*, for being held by the same. Further, the one end of the ground plate 31 is formed with cutouts 31*b* adjacent to the respective shaft-holding portions 31*a*. The other end of the ground plate 31 is formed with a pair of tabs 31*c*.

Grooves 11*h* for pivotally supporting opposite ends of the shaft 32 are formed in a pair of support plates 11*b* of first housing 11. The ends of the shaft 32 are removable from the grooves 11*h*. When the shaft 32 is mounted in the grooves 11*h*, it is possible to pivot the ground plate 31 with respect to the first connector section 1. Further, it is also possible to remove the ground plate 31 from the first connector section 1. Further, the first housing 11 is formed with a conductive path, not shown, for electrically connecting the ground plate 31 to a ground pattern, not shown, of the printed wiring board 9 via the shaft 32.

To mount the ground plate 31 on the first connector section 1, as shown in FIG. 13A, first, the first function expansion card 7 is connected to the first connector section 1.

Then, the shaft 32 is inserted into the grooves 11*h* of the support plates 11*b* of the first connector section 1.

After that, the ground plate 31 is pivoted with the shaft 32 as the center of pivotal motion such that a free end of the ground plate 31 moves toward the second connector section 2.

When the ground plate 31 is pivoted toward the second connector section 2, as shown in FIG. 13C, the first function expansion card 7 is covered by the ground plate 31. At this time, as shown in FIG. 13D, interference between the support plates 11*b* of the first connector section 1 and the ground plate 31 is prevented by the cutouts 31*b* of the ground plate 31.

Further, when the ground plate 31 becomes parallel to the first function expansion card 7, the tabs 31*c* of the ground plate 31 abut against a riser surface 21*i* formed on the second housing 21 of the second connector section 2, whereby the pivotal motion of the ground plate 31 is stopped.

After that, if the second function expansion card 8 is connected to the second connector section 2, the ground plate 31 comes to exist between the first function expansion card 7 and the second function expansion card 8.

According to the second embodiment, it is possible to obtain the same advantageous effects as provided by the first embodiment, and more positively eliminate adverse influence of noise since the ground plate 31 exists between the first and second function expansion cards 7 and 8.

It should be noted that although in the above-described embodiments, the upper contacts 12 and the lower contact 13 are arranged in the first housing 11 as the first contacts, and the upper contacts 22 and the lower contacts 23 are arranged in the second housing 21 as the second contacts, this is not limitative, but only either the upper contacts 12 and 22, or the lower contacts 13 and 23 may be provided, depending on the kind of the card-type electronic device.

Further, although in the above-described embodiments, the card connector is provided for the first and second function expansion cards 7 and 8, this is not limitative, but it can be used as a connector for card-type electronic devices, such as memory cards.

It should be noted that although in the second embodiment, the ground plate 31 is disposed in a manner pivotable and removable with respect to the first connector section 1, the ground plate 31 may be disposed only in a manner pivotable with respect to the first connector section 1 or only in a manner removable with respect to the same.

Further, although in the second embodiment, the ground plate 31 is disposed in the first connector section 1, the ground plate 31 may be disposed in the second connector section 2.

Furthermore, although in the second embodiment, the ground plate 31 is electrically connected to the ground pattern of the printed wiring board 9, a plate interposed between the function expansion cards 7 and 8 may not be grounded.

It is further understood by those skilled in the art that the foregoing are the preferred embodiments of the present invention, and that various changes and modification may be made thereto without departing from the spirit and scope thereof.

What is claimed is:

1. A connector comprising:

a first connector section mounted on a circuit board for electrically connecting to the circuit board a first one of two card-type electronic devices opposed to each other with a predetermined gap therebetween; and a second connector section mounted on the circuit board for electrically connecting to the circuit board the other one of the two card-type electronic devices, wherein said first connector section includes:

first contacts for electrically connecting a first terminal section disposed at a front end of the first card-type electronic device to the circuit board, and a first housing having a first receiving hole for holding said first contacts and receiving the first terminal section, wherein said second connector section includes:

second contacts for electrically connecting a second terminal section disposed at a front end of the other card-type electronic device to the circuit board, and a second housing having a second receiving hole for holding said second contacts and receiving the second terminal section, wherein the first housing supports a rear end of the other card-type electronic device when the second terminal section of the other card-type electronic device is received by the second receiving hole; and wherein the second housing supports a rear end of the first card-type electronic device when the first terminal section of the first card-type electronic device is received by the first receiving hole.

2. A connector as claimed in claim 1, further comprising an electrically conductive plate disposed between the two card-type electronic devices.

3. A connector as claimed in claim 2, further comprising a conductive path for electrically connecting said plate with a ground pattern of the circuit board.

4. A connector as claimed in claim 2, wherein said plate is detachably coupled to one of said first housing and said second housing.

5. A connector as claimed in claim 4, further comprising a conductive path for electrically connecting said plate with a ground pattern of the circuit board.

6. A connector as claimed in claim 2, wherein said plate is pivotally coupled to one of said first housing and said second housing.

7. A connector as claimed in claim 6, further comprising a conductive path for electrically connecting said plate with a ground pattern of the circuit board.

8. A connector as claimed in claim 1, wherein said first connector section further comprises a first locking device disposed in said first housing for holding the rear end of the other card-type electronic device, wherein said second connector section further comprises a second locking device disposed in said second housing for holding the rear end of the first card-type electronic device, wherein said first locking device comprises:

a first locking section for engagement with the rear end of the other card-type electronic device supported by said first connector section;

a first spring section disposed in said first housing for urging said first locking section toward the rear end of the other card-type electronic device; and a first guide section disposed in said first housing for engagement with said first spring section to restrict said first spring section from bending in a direction other than a plane direction of the circuit board, and wherein said second locking device comprises:

a second locking section for engagement with the rear end of the first card-type electronic device supported by said second connector section;

a second spring section disposed in said second housing for urging said second locking section toward the rear end of the first card-type electronic device; and a second guide section disposed in said second housing for engagement with said second spring section to restrict said second spring section from bending in a direction other than the plane direction of the circuit board.

9. A connector as claimed in claim 8, further comprising an electrically conductive plate disposed between the two card-type electronic devices.

10. A connector as claimed in claim 9, further comprising a conductive path for electrically connecting said plate with a ground pattern of the circuit board.

11. A connector as claimed in claim 9, wherein said plate is pivotally coupled to one of said first housing and said second housing.

12. A connector as claimed in claim 11, further comprising a conductive path for electrically connecting said plate with a ground pattern of the circuit board.

13. A connector as claimed in claim 4, wherein said plate is pivotally coupled to the one of said first housing and said second housing.

14. A connector as claimed in claim 13, further comprising a conductive path for electrically connecting said plate with a ground pattern of the circuit board.

15. A connector as claimed in claim 9, wherein said plate is detachably coupled to one of said first housing and said second housing.

16. A connector as claimed in claim 15, further comprising a conductive path for electrically connecting said plate with a ground pattern of the circuit board.

17. A connector as claimed in claim 15, wherein said plate is pivotally coupled to the one of said first housing and said second housing.

18. A connector as claimed in claim 17, further comprising a conductive path for electrically connecting said plate with a ground pattern of the circuit board.

19. A connector comprising:

a first connector section mounted on a circuit board for electrically connecting to the circuit board a first one of two card-type electronic devices opposed to each other with a predetermined gap therebetween; and a second connector section mounted on the circuit board for electrically connecting to the circuit board the other one of the two card-type electronic devices, wherein said first connector section includes:

first contacts for electrically connecting a first terminal section disposed at a front end of the first card-type electronic device to the circuit board, and a first housing for holding said first contacts and supporting the first terminal section, wherein said second connector section includes:

second contacts for electrically connecting a second terminal section disposed at a front end of the other card-type electronic device to the circuit board, and a second housing for holding said second contacts and supporting the second terminal section, wherein said first connector section further comprises a first locking device disposed in said first housing for holding a rear end of the other card-type electronic device, wherein said second connector section further comprises a second locking device disposed in said second housing for holding a rear end of the first card-type electronic device, wherein said first locking device comprises:

a first locking section for engagement with the rear end of the other card-type electronic device supported by said first connector section;

a first spring section disposed in said first housing for urging said first locking section toward the rear end of the other card-type electronic device; and a first guide section disposed in said first housing for engagement with said first spring section to restrict said first spring section from bending in a direction other than a plane direction of the circuit board, and wherein said second locking device comprises:

a second locking section for engagement with the rear end of the first card-type electronic device supported by said second connector section;

a second spring section disposed in said second housing for urging said second locking section toward the rear end of the first card-type electronic device; and a second guide section disposed in said second housing for engagement with said second spring section to restrict said second spring section from bending in a direction other than the plane direction of the circuit board.

* * * * *